US010449437B1

(12) United States Patent
Curtis

(10) Patent No.: US 10,449,437 B1
(45) Date of Patent: Oct. 22, 2019

(54) GRASP AND TUG TOY

(71) Applicant: Christopher P. Curtis, Cave Creek, AZ (US)

(72) Inventor: Christopher P. Curtis, Cave Creek, AZ (US)

( * ) Notice: Subject to any disclaimer, the term of this patent is extended or adjusted under 35 U.S.C. 154(b) by 165 days.

(21) Appl. No.: 15/631,262

(22) Filed: Jun. 23, 2017

(51) Int. Cl.
*A63F 9/00* (2006.01)
*A63B 21/28* (2006.01)

(52) U.S. Cl.
CPC ..... *A63F 9/00* (2013.01); *A63B 21/28* (2013.01); *A63F 2250/48* (2013.01)

(58) Field of Classification Search
CPC ..... A63B 71/00; A63B 9/00; A63F 9/24
USPC ..... 273/451
See application file for complete search history.

(56) References Cited

U.S. PATENT DOCUMENTS 3,735,663 A 5/1973 Cowell, Sr.
3,770,275 A 11/1973 Moore
4,039,185 A 8/1977 Rhodes
4,211,402 A 7/1980 Carroll
4,347,773 A 9/1982 Zook
5,324,222 A * 6/1994 Chen ..... A61C 15/041 446/34
5,647,809 A * 7/1997 Yip ..... A63B 43/00 446/220
5,925,391 A * 7/1999 Whetstone, Jr. ..... A23G 1/505 426/104
5,938,499 A * 8/1999 Chen ..... A63H 1/32 446/253
6,379,725 B1 * 4/2002 Wang ..... A01K 15/026 426/104
D539,855 S * 4/2007 Ban ..... D21/386
7,553,259 B2 6/2009 Landfair
D603,449 S 11/2009 Whetstine
8,573,159 B1 * 11/2013 Crotty ..... A01K 15/025 119/707
D738,954 S 9/2015 Panagiotes
D768,410 S * 10/2016 Jennings ..... D6/601
2017/0106298 A1 * 4/2017 Mcdonald ..... A63H 29/22

* cited by examiner

*Primary Examiner* — John E Simms, Jr.
*Assistant Examiner* — Dolores R Collins
(74) *Attorney, Agent, or Firm* — Thomas W. Galvani, P.C.; Thomas W. Galvani

(57) ABSTRACT

A toy is used for play between two players who grasp and tug at the toy in an attempt to wrest the toy from the other player's grasp. The toy has a solid body with two identical lobes arranged on a long axis of the body on opposed sides of the body. The lobes each have a truncated ovate shape with a base, and the bases of the lobes proximate to each other. The lobes are rotationally offset with respect to each other about the long axis.

19 Claims, 7 Drawing Sheets

GRASP AND TUG TOY

FIELD OF THE INVENTION

The present invention relates generally to toys, and more particularly to hand toys.

BACKGROUND OF THE INVENTION

Toys for children are constantly evolving. For thousands of years, children have been entertained in imaginative and competitive play by toys. In the 1700s, children gained autonomy, and toys proliferated in type and number. Toys such as puzzles, hoops, and rocking horses were first available to the wealthy, and then gradually became more available to the lower classes.

Toys evolved with time. In the next century, educational toys became more important. Reading books and religious toys, board games and decks of counting cards were prominent. The industrial revolution brought an increase in both the complexity of toys and the methods for manufacturing them. Widespread, mass production of toys became possible.

The rise of middle class society in the early 1900s allowed families to purchase more toys, driving demand up. In 1902, a cartoonist immortalized the story of President Theodore Roosevelt refusing to kill a bear, and an entrepreneurial toy maker invented the teddy bear, an iconic toy which is still one of the most popular in the entire world.

The emergence of plastics and plastics manufacturing allowed toy makers to push the boundaries of toy making. Articulated action figures, lightweight planes, even spring-loaded Styrofoam guns were introduced. Radio frequency controls were incorporated, and RC cars, planes, boats, and helicopters became popular.

The computer revolution next ushered in video games. Initially, games were limited to basic text-based adventure stories. Graphics were added, and early games like Pong were developed. Movement in different directions and joystick controls made classic games like Mario Brothers and Zelda possible. Video games have become an immensely popular form of entertainment and span the age ranges. Video games are now available not only on dedicated consoles, but also on mobile devices like phones and tablets. Some phones can be used with specialized headsets for virtual-reality experiences. Games, screens, and distractions are now at everyone's fingertips.

The technology behind games is moving forward with astonishing speed. Some academics have questioned whether we will be able to decipher reality from virtual reality at some point in the future. Indeed, some question whether we might already be living in a simulation. Despite all this, there exists a segment of the population that wishes to return to analog games, simpler toys, and face-to-face experiences between people. For this segment, a new toy will always be needed.

SUMMARY OF THE INVENTION

A grasp and tug toy is used for play between two players who grasp and tug at the toy in an attempt to wrest the toy from the other player's grasp. The toy has a solid body with two opposed lobes that are gasped by the opposing players and pulled.

In an embodiment, a grasp and tug toy includes a solid body having two identical lobes arranged on a long axis of the body on opposed sides of the body, and the lobes each have a truncated ovate shape with a base, wherein the bases of the lobes are proximate to each other. The lobes are rotationally offset with respect to each other about the long axis, each lobe includes opposed upper and lower concavities, and the upper and lower concavities of each lobe are rotationally offset with respect to each other along the long axis. The upper and lower concavities of each lobe are aligned with respect to each other laterally away from the long axis. The upper concavity of each lobe is elongate along the long axis, and the lower concavity of each lobe is elongate transverse to the long axis. The lower concavity of each lobe is concave along the long axis and is convex transverse to the long axis. The upper concavities of the lobes are rotationally offset with respect to each other about the long axis, and the lower concavities of the lobes are rotationally offset with respect to each other about the long axis.

In another embodiment, a grasp and tug toy includes a solid body having two opposite and identical lobes, wherein the lobes are rotated with respect to each other along a long axis of the body, and the lobes each have upper and lower diametrically opposed concavities to receive a thumb and non-thumb finger, respectively, when each lobe is grasped by two opposing players. The upper and lower concavities of each lobe are offset with respect to each other along the long axis. The upper and lower concavities of each lobe are aligned with respect to each other laterally away from the long axis. The upper concavity of each lobe is elongate along the long axis, and the lower concavity of each lobe is elongate transverse to the long axis. The lower concavity of each lobe is concave along the long axis and is convex transverse to the long axis. The upper concavities of the lobes are rotationally offset with respect to each other about the long axis, and the lower concavities of the lobes are rotationally offset with respect to each other about the long axis.

In another embodiment, a grasp and tug toy includes a solid body having two lobes arranged on a long axis of the body on opposed sides of a frontal plane bisecting the body normal to the long axis, wherein the body includes first, second, third, and fourth octants on a first side of the frontal plane, and first, second, third, and fourth octants on a second side of the frontal plane. The lobes extend through the octants, and each of the first, second, third, and fourth octants on the first side is identical and inverted with respect to the first, second, third, and fourth octants on the second side of the frontal plane, respectively. Each of the first, second, third, and fourth octants on the first side is rotated with respect to the first, second, third, and fourth octants on the second side of the frontal plane, respectively. Each lobe includes opposed upper and lower concavities, and the upper and lower concavities of each lobe are offset with respect to each other along the long axis. The upper concavity of each lobe is elongate along the long axis, and the lower concavity of each lobe is elongate transverse to the long axis. The upper concavities of the lobes are rotationally offset with respect to each other about the long axis, and the lower concavities of the lobes are rotationally offset with respect to each other about the long axis. The upper concavity is shallower than the lower concavity along the long axis.

The above provides the reader with a summary of some embodiments discussed below. Simplifications and omissions are made, and the summary is not intended to limit or define in any way the scope of the invention or key aspects thereof. Rather, this brief summary merely introduces the reader to some aspects of the invention in preparation for the detailed description that follows.

BRIEF DESCRIPTION OF THE DRAWINGS

Referring to the drawings.

DETAILED DESCRIPTION

Figure 1A:
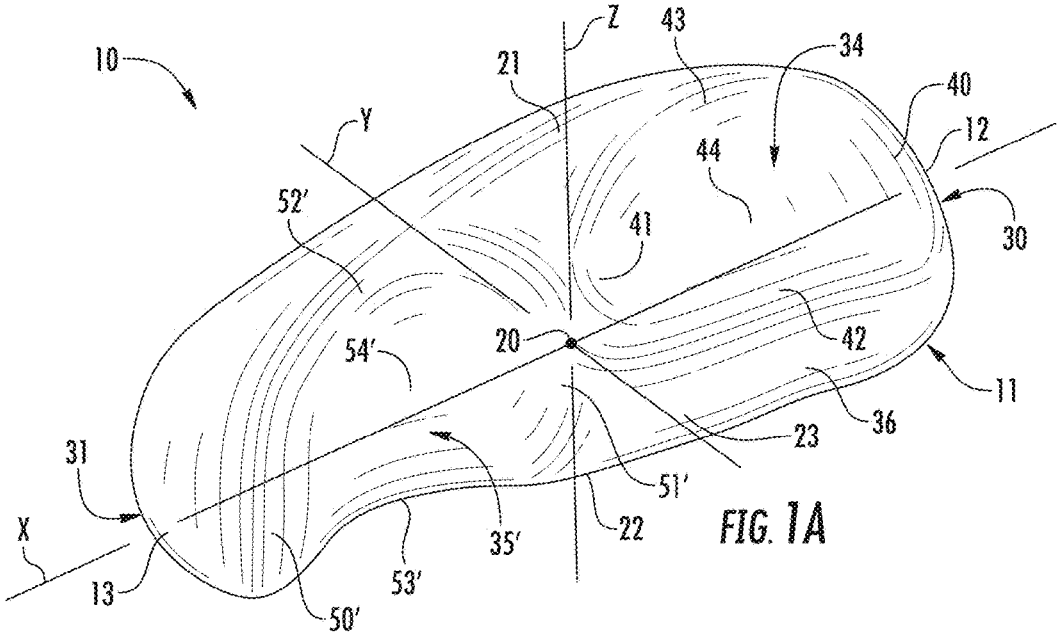
FIGS. 1A and 1B are top-left and bottom-right perspective views of a grasp and tug toy, respectively.

Reference now is made to the drawings, in which the same reference characters are used throughout the different figures to designate the same elements. The drawings illustrate a grasp and tug toy 10 inspiring face-to-face interaction through finger-to-finger competition. The toy 10 has a body 11 that can be handled by two opposing players, each gripping the toy 10 between their thumb and index or other non-thumb finger. The toy 10 has a rigid, solid body 11 that does not deform or compress, so that the players can squeeze it and test their finger strength against each other in fun, competitive play.

Figure 8:
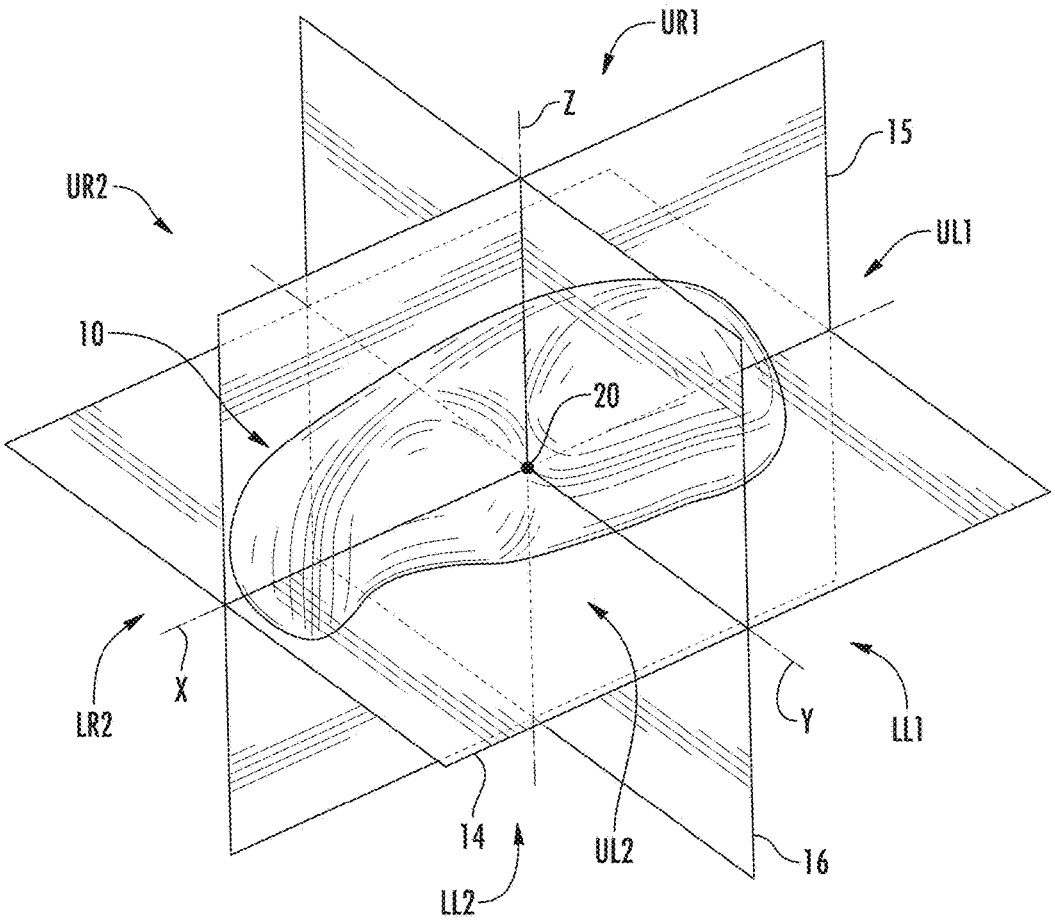
FIG. 8 is a top-left perspective similar to FIG. 1A with transverse, sagittal, and frontal planes overlying the grasp and tug toy.
Figure 9A:
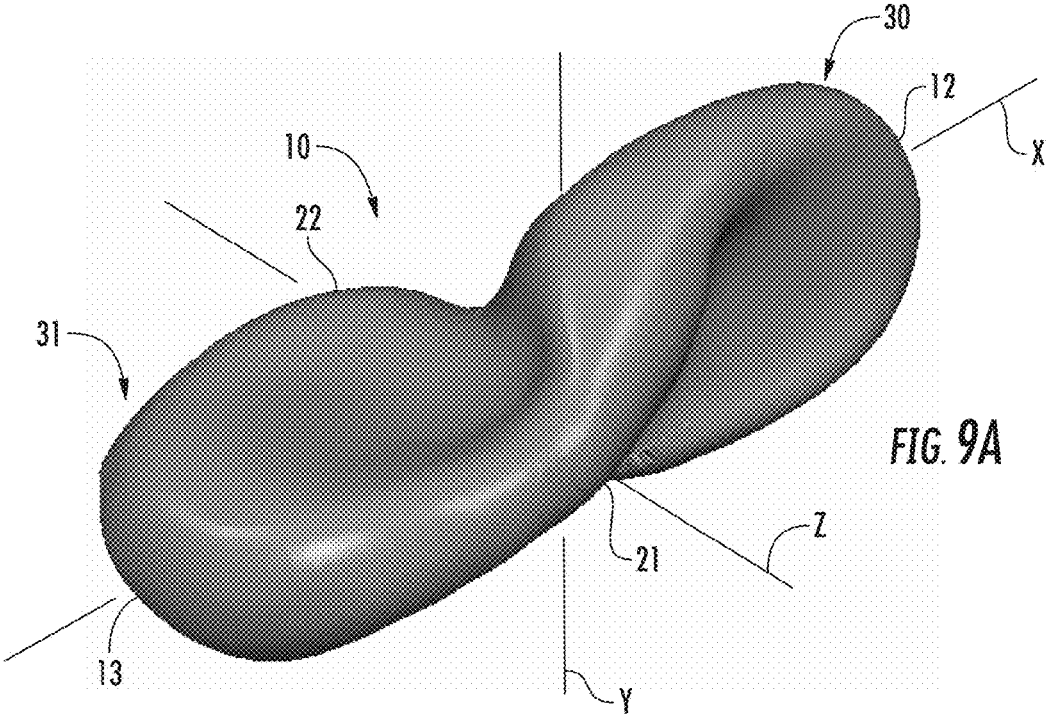
FIGS. 9A and 9B are three-dimensional renderings of the grasp and tug toy, intended to provide an alternate visual depiction thereof.
Figure 9B:
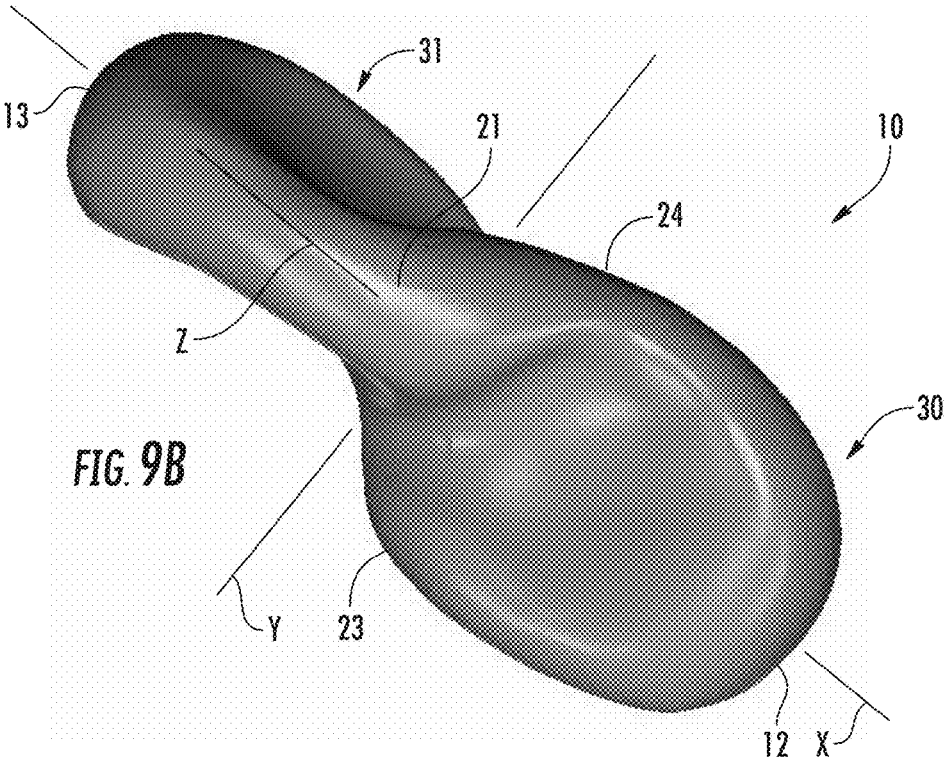

The toy 10 has an unusual shape. FIGS. 1A-7B are black and white line drawings which illustrate the shape, contours, and concavities of the body 11. FIG. 8 illustrates the arrangement of features with respect to each other on the body 11. And FIGS. 9A and 9B are shaded illustrations which further illustrate the features of the body 11. Each of these different illustrations is intended to aid the reader in the understanding of the structure of the toy 10.

Referring first to FIG. 1A, the body 11 of the toy 10 has opposed first and second ends 12 and 13. The first and second ends 12 and 13 are opposed to each other along a long or longitudinal axis X of the body 11. The body 11 is elongate with a major dimension extending along this longitudinal axis X. The body 11 additionally has two other short axes: vertical axis Z extending normal to the longitudinal axis X and horizontal axis Y extending normal to the longitudinal axis X. The three axes demarcate three different planes and eight different octants of the body 10.

Referring now to FIG. 8, the planes and octants are shown. The toy 10 is shown along with the axes X, Y, and Z. Overlaid on the toy 10 are three planes. The axes X, Y, and Z establish a language for a geometry that, though slightly tedious, describes well the arrangement of elements with respect to each other on the body 11. Therefore, an explanation of the geometry is undertaken to aid the reader in better understanding the toy 10. The axes X and Y commonly lie in and thus define a transverse plane 14, which in turn defines an upper half of the body 11 above the transverse plane and an opposed lower half below it. Briefly, terms like "upper," "lower," "front," "rear," "left," and "right" are used herein for the convenience of description, are generally used with reference to the player holding the toy 10 at the first end 12 and in a position roughly shown in FIG. 1A, and are not intended to limit the structure, orientation, or use of the toy 10. The axes X and Z commonly lie in and thus define a sagittal plane 15, which in turn defines a right half of the body 11 "in front" of the sagittal plane 15 on the page, as it is shown on the page, and an opposed left half of the body 11 "behind" the sagittal plane 15, as it is shown on the page. Lastly, the axes Y and Z commonly lie in and define a frontal plane 16, which in turn defines a first (or front) half of the body 11 proximate the first end 12 and an opposed second (or rear) half of the body 11 proximate the second end 13.

The three axes X, Y, and Z intersect at a geometric center or centroid 20 of the body 11. The three planes 14, 15, and 16 extend outwardly from the centroid 20 and demarcate eight octants of the body 11 with respect to the centroid 20. Each octant is a three-dimensional division of the body 11. For simplicity and clarity, the octants are identified through a naming convention corresponding to their location with respect to the three planes 14, 15, and 16, and as such, the reference characters identifying the octants in the drawings point to the space the octant occupies between the three planes X, Y, and Z, and may not point directly to the body 11.

The naming convention for the octants includes three characters representing the octant's location with respect to the transverse, sagittal, and frontal planes 14, 15, and 16. "U" and "L" indicate "upper" and "lower" with respect to the transverse plane, "1" and "2" indicate proximate to the "first end" 12 and "second end" 13 with respect to the sagittal plane 15, "L" and "R" indicate "left" and "right" with respect to the frontal plane 15. For example, in FIG. 8, the octant shown at the center of the page is octant UL2; it is an upper, left, second octant. In other words, octant UL2 is above the transverse plane 14, to the left of the sagittal plane 15, and toward the second end 13 from the frontal plane 16. All of the octants are identified in FIG. 8 except octant LR1, as it is obscured in the drawing. However, one having ordinary skill in the art will readily appreciate that octant LR1 is adjacent octant LL1 and below octant UR1.

Returning to FIGS. 1A and 1B, the body 11 of the toy 10 has a top 21 and an opposed bottom 22. In FIG. 1A, the toy 10 is in a top 21-up orientation, while in FIG. 1B, the toy 10 is in a bottom 22-up orientation. The body 11 additionally has a left extremity 23 and an opposed right extremity 24.

The body 11 has two opposed lobes. The lobes are demarcated by the frontal plane 16 into a first lobe 30 and a second lobe 31. The first lobe 30 constitutes all of the body 11 between the frontal plane 16 and the first end 12. Likewise, the second lobe 31 constitutes all of the body 11 between the frontal plane 16 and the second end 13. The first and second lobes 30 and are opposed to each other, but are also identical. While identical, the first and second lobes 30 and 31 are not mirror identical; rather, they are rotationally offset about the axis X and display what is later defined as "mirrored, inverted, rotated symmetry." Because the first and second lobes 30 and 31 are identical, however, they have identical structural elements and features, and, as such, only the structural elements and features of the first lobe 30 will be described, with the understanding that the description applies equally to the structural elements and features of the second lobe 31. Moreover, the reference characters used to identify the structural elements and features of the first lobe 30 will also be used to identify the same structural elements and features of the second lobe 31, but will be marked with a prime ("′") symbol so as to distinguish them from those of the first lobe 30.

Figure 2:
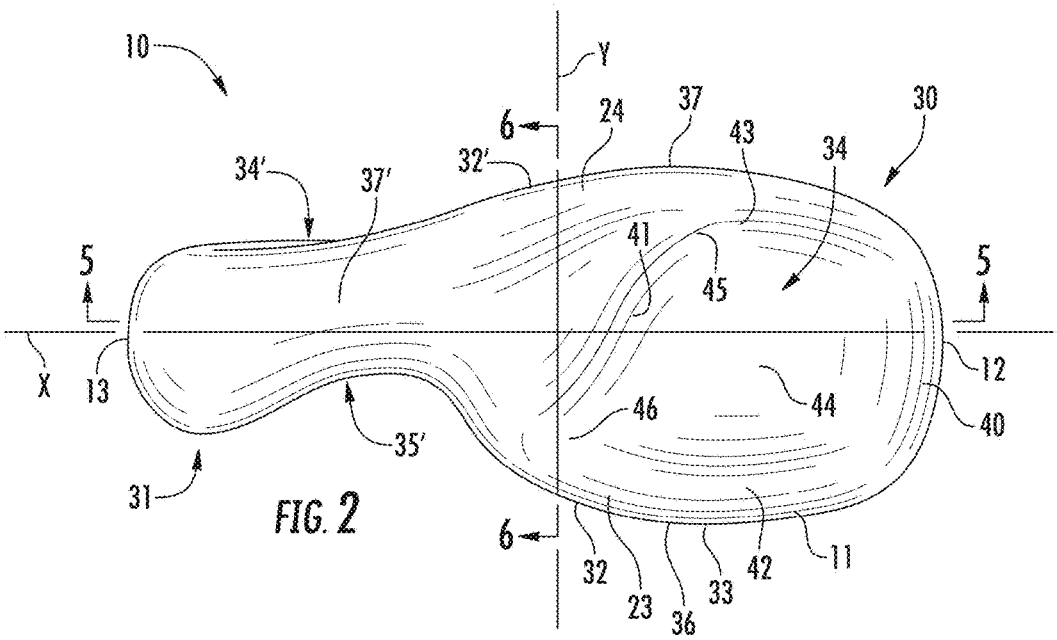
FIG. 2 is a top view of the grasp and tug toy.
Figure 3:
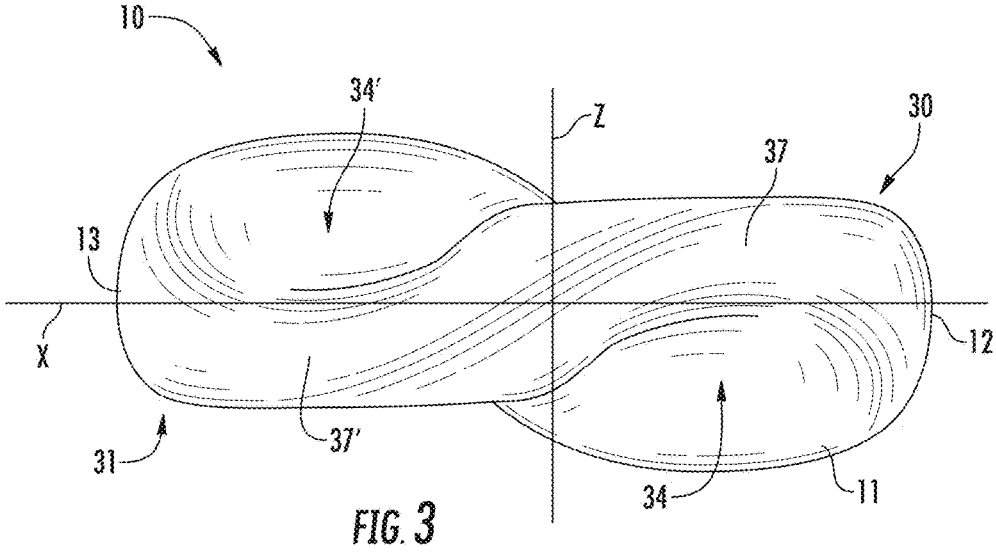
FIG. 3 is a left side elevation view of the grasp and tug toy.
Figure 4:
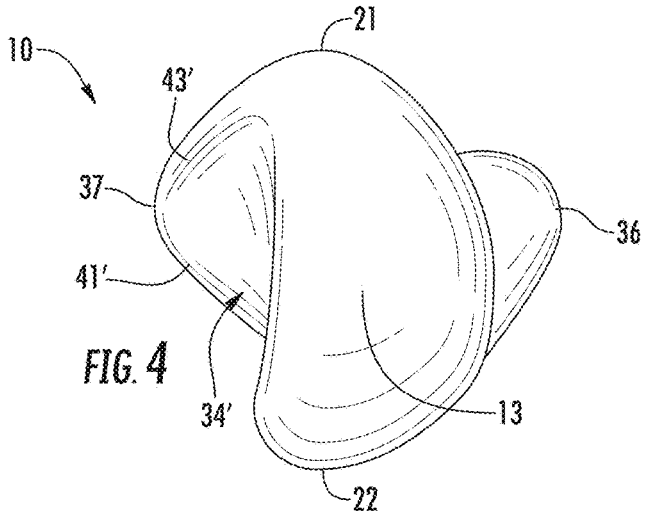
FIG. 4 is a rear elevation view of the grasp and tug toy.

The first lobe 30 has a base 32 and a truncated ovate shape extending parallel to the transverse plane 14. Referring to FIG. 2, which is a top view of the toy 10, the base 32 is at an inner end of the first lobe 30 proximate to the frontal plane 16 (as shown in FIG. 8), opposed from the first end 12. The base 32 is thus proximate the base 32' of the second lobe 31. The base 32 is a wide portion at one end of the first lobe 30, whereas the first end 12 defines the opposed end of the first lobe 30. The base 32 is formed integrally and monolithically to the base 32' of the opposing second lobe 31. Left and right edges 36 and 37 extend from the base 32 to the first end 12. These left and right edges 36 and 37 extend along the left and right extremities 23 and 24 on the first lobe 30. As shown from the top view of FIG. 2, between the left and right edges 36 and 37, the first lobe 30 expands from the base 32 and has a truncated ovate shape. An ovate shape is generally an egg shape, defined as having a shape with a broad end at the base which then expands and then narrows, such as in a leaf or a longitudinal section of an egg. A truncated ovate shape is characterized as an ovate shape which is shortened or flattened at a top. Thus, rather than terminating in a point or tip, as in a leaf or an egg, a truncated egg shape terminates in a blunt or broad end opposed from the base. Accordingly, the first lobe 30 has a truncated ovate shape in a transverse plane: when a section of the first lobe 30 either at or parallel and near to the transverse plane 14 is taken, the base 32 is broad, then widens slightly to a middle portion 33 of the lob 30, then narrows at the first end 12. The first end 12 is blunt and broad, but is still narrower than the base 32. This truncated ovate shape, when grasped between the thumb and index finger as will be explained, provides the player with a unique grip, as the player has the most surface area available when his thumb and index finger are closer to the base 32. When the toy 10 is pulled from the player, his thumb and index finger slip away from the base 32 and have less and less surface available to be gripped in both the longitudinal and horizontal directions, thereby providing a unique challenge during gameplay. Other shapes for the lobes, such as square, rectangular, oval, etc., do not provide this unique advantage.

Figure 5:
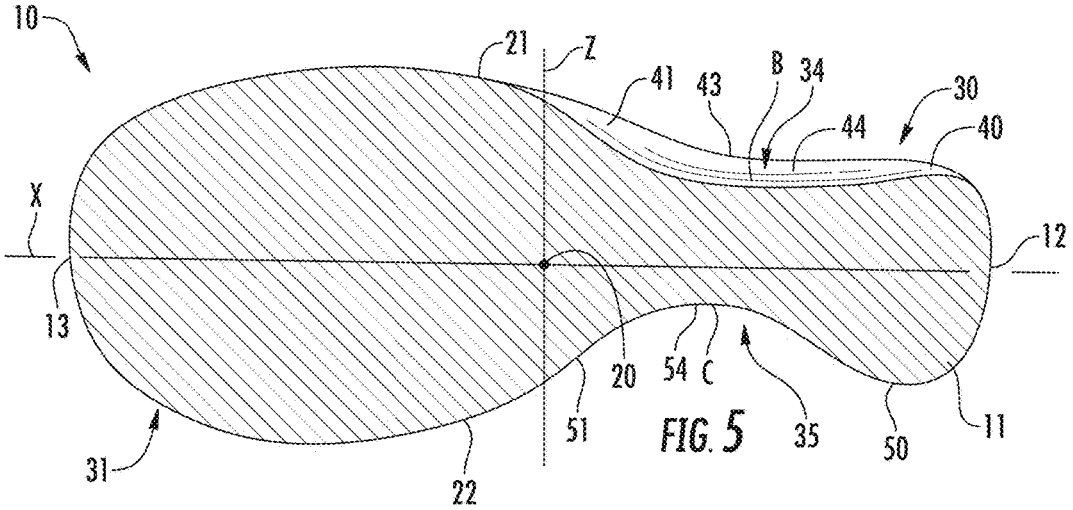
FIGS. 5 and 6 are section views of the grasp and tug toy taken along lines 5-5 and 6-6, respectively, in FIG. 2.
Figure 6:
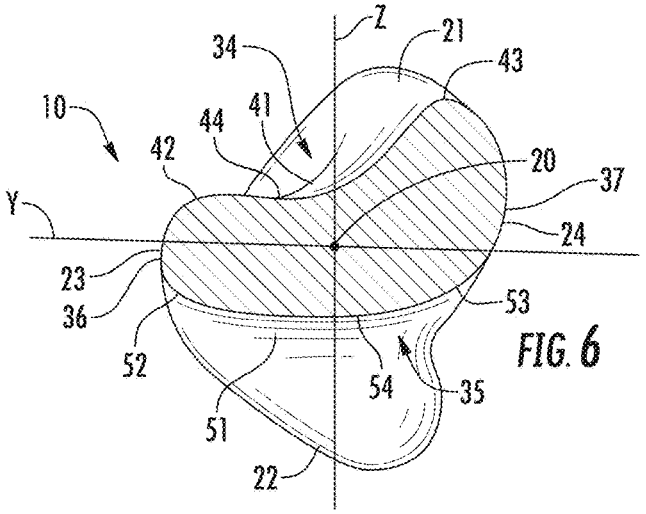

The first lobe 30 has two concavities 34 and 35, diametrically opposed from each other across the body 11 and offset along the long axis X. The concavities 34 and 35 are different from each other in size, shape, and arrangement, and are spaced apart from each other. The concavity 34 is an upper concavity, whereas the concavity 35 is a lower concavity. Concavity 34 is shown best in FIGS. 1A, 2, 5, and 6. Concavity 34 is elongate and arranged along the longitudinal axis X: it includes a first end 40, an opposed second end 41, and opposed left and right ridges 42 and 43, and the first and second ends 40 and 41 are further apart than the left and right ridges 42. The first and second ends 40 and 41 and the left and right ridges 42 and 43 define outer boundaries of an inset cradle 44 extending into the body 11 from the first and second ends 40 and 41 and the left and right ridges 42 and 43. The cradle 44 is a depression into the body 11 and dips below the first and second ends 40 and 41 and the left and right ridges 42 and 43. The cradle 44 is concave into the body 11 in both axial and transverse directions, as seen in FIGS. 5 and 6, respectively. The cradle 44, together with the first and second ends 40 and 41 and the left and right ridges 42 and 43, form the concavity 34: the cradle 44 defines the floor of the concavity 43 and the first and second ends 40 and 41 and the left and right ridges 42 and 43 define the ridges surrounding and bounding the cradle 44.

As can be seen in FIG. 2, the left ridge 42 is nearly straight, bowing slightly outward away from the axis X. The left ridge 42 is only slightly humped. With brief reference to FIG. 6, which shows a section view taken along the line 6-6 in FIG. 2 parallel to the frontal plane 16, it can be seen that the cradle 44 defines a vertical low point of the concavity 34, and that the concavity 34 humps slightly at the left ridge 42. In other words, the concavity rises slightly and smoothly to the left ridge 42, which then has a rounded surface that transitions smoothly into the left edge 36. This humped left ridge 42 provides characteristic features and functions of the toy 10: when the player grips the first lobe 30 with his thumb in the concavity 34, the thumb is preferably positioned in the cradle 44 but can extend over the left ridge 42. This allows the player to horizontally (along the Y-axis) slide, angle, and orient his thumb for comfortable positioning. However, the left ridge 42 provides no stop for the thumb, which means that the thumb can slip out of the concavity 34 over the left ridge 42, should the opposing player pull, pivot, turn, rock, torque, or otherwise move the toy 10 from the player. Therefore, the humped left ridge 42 allows the player to adopt a wide variety of thumb grip positions on the toy, but allows the toy 10 to be wrested from the player through the left ridge 42.

The right ridge 43 has a pronounced hump. Referring still to FIG. 6, the concavity 34 rises sharply and significantly to the right ridge 43 and then smoothly and concavely transitions to the right edge 37. The cradle is roughly parallel to the axis Y, the concavity rises 34 at a roughly forty-five degree angle with respect to the axes Y and Z from the cradle 44. Because of the vertical rise above the cradle 44 from the right ridge 43, the right edge 37 has a surface roughly twice as tall as that of the left edge 36. This humped right ridge 43 provides characteristic features and functions of the toy 10: when the player grips the first lobe 30 with his thumb in the concavity 34, the thumb is prevented from moving horizontally (along the axis Y) toward the right edge 37. As such, the right ridge 43 defines a stop for the thumb, and can also be used by the player advantageously as a brace to defend against torque exerted by the other player or as a brace to create torque to wrest the toy 10 from the other player.

Returning to FIG. 2, the second end 41 is shown as a series of diagonal contour lines. FIGS. 5 and 6 show the slope of the second end 41. However, FIG. 2 shows that the second end is generally oriented at an approximately forty-five degree angle with respect to the axes X and Y. The concavity 34 thus terminates proximate to the frontal plane 16 in a transverse or diagonal manner. Because of this, the concavity 34 is slightly longer (along the axis X) proximate to the left ridge 42 than proximate to the right ridge 43. As such, when the first lobe 30 is gripped between the thumb and index finger, the thumb can extend axially further over the first lobe 30 proximate to the left ridge 42. Because the toy 10 is generally designed to be preferably held in the player's right hand, this allows the player's hand to open up: the thumb can move away from the palm, which creates a more powerful grip between the thumb and index finger. This, in turn, creates more powerful play and a more exciting game between two players.

The second end 41 smoothly transitions from the right ridge 43 to the left ridge 42. The right ridge 43 is aligned nearly parallel to the axis X. The right ridge 43 is oriented slightly away from the axis X as it extends toward the frontal plate 16. The right ridge 43 and second end 41 meet at a right inflection point 45 which defines the intersection of the right ridge 43 and second end 41. The second end 41 extends away from the right inflection point 45 at an obtuse angle with respect to the right ridge 43 that is between approximately one hundred twenty degrees and approximately one hundred fifty degrees.

Although the second end 41 is oriented obliquely at approximately forty-five degrees with respect to the axes X and Y, the second end 41 is not straight. Rather, a portion of the second end 41 which is proximate to the right ridge 43 has a concave shape with respect to the frontal plane 16 (the right ridge 43 bows slightly into the frontal plane 16). This portion extends from the inflection point 45 to a generally intermediate distance along the second end 41. Similarly, a portion of the second end 41 which is proximate to the left ridge 42 has a convex shape with respect to the frontal plane 16 (the second end 41 bows slightly away from the frontal plane 16). This portion extends from the generally intermediate distance along the second end 41 to proximate the left ridge 42. The second end 41 thus has a low-amplitude sinusoidal shape that extends obliquely with respect to the axes X and Y.

The second end 41 terminates at a left inflection point 46, defining the intersection of the left ridge 42 and the second end 41. The second end 41 and the left inflection point 46 are oriented acutely with respect to each other, at an angle of between approximately fifty-five degrees and approximately eighty-five degrees. As is seen in FIG. 5, which is a section view taken along the line 5-5 in FIG. 2 parallel to the concavity 34 rises from the cradle 44 to the second end 41 with a gentle slope of approximately fifteen to approximately thirty degrees. Near the right ridge 43, the slope is higher, while near the left ridge 42, the slope is lower.

The first end 40 defines the end of the concavity 34 proximate to the first end 12 of the body 11. The first end 40 is a rounded edge of the toy 10, and projects slightly above the cradle 44 but then roundly transitions over to a steep vertical face defining the first end 12. The first end 40 is slightly convex with respect to the frontal plane 16 (the first end 40 bows slightly away from the frontal plane 16) but is otherwise aligned generally parallel to the frontal plane 16. The left and right ridges 42 and 43 extend from opposed ends of the first end 40 at slightly obtuse angles just over ninety degrees, since the left and right ridges 42 and 43 bow outwardly from the opposed ends of the first end 40.

The lower concavity 35 is opposed from the upper concavity 34 and has a different orientation. While the upper concavity 34 is located proximate the top 21 of the body 11, the lower concavity 35 is located proximate the bottom 22 of the body 11. And, while the upper concavity 34 extends generally parallel to the axis X, the lower concavity 35 is transverse to the upper concavity 34, extending generally parallel to the axis Y.

The lower concavity 35 is best shown in FIGS. 1B, 3, 5, and 6. Along its transverse orientation, the concavity 35 includes a first end 50, an opposed second end 51, a left ridge 52, an opposed right ridge 53, and a cradle 54. The lower concavity is elongate in a direction parallel to the axis Y; the first and second ends 50 and 51 are closer together than are the left and right ridges 52 and 53. The first and second ends 50 and 51 and the left and right ridges 52 and 53 define outer boundaries of the inset cradle 54 extending into the body 11 from the first and second ends 50 and 51 and the left and right ridges 52 and 53. The cradle 54 is a depression into the body 11 and dips below the first and second ends 50 and 51 and the left and right ridges 52 and 53 (when the toy 10 is in a bottom 22-up position). The cradle 54 is concave into the body 11 in the axial direction (generally parallel to the axis X) but is convex out of the body 11 in the transverse direction (generally parallel to the axis Y). In other words, the concavity 35 is bowed outwardly away from the centroid 20 between the left and right ridges 52 and 53, as shown in FIG. 6, and the concavity 35 is bowed inwardly toward the centroid 20 between the first and second ends 50 and 51, as shown in FIG. 5. The cradle 54, together with the first and second ends 50 and 51 and the left and right ridges 52 and 53, form the concavity 35: the cradle 54 defines the floor of the concavity 35 and the first and second ends 50 and 51 and the left and right ridges 52 and 53 define the ridges surrounding and bounding the cradle 54.

Figure 1B:
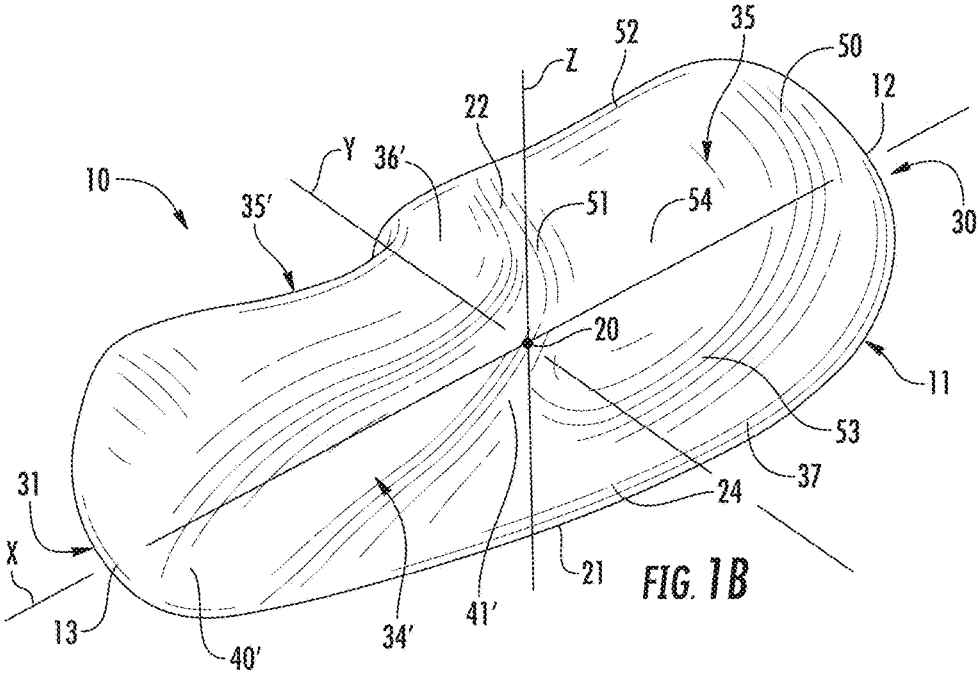

As can be seen in FIG. 1B, the left ridge 52 is nearly straight, bowing only slightly outward away from the axis X. This corresponds to the slightly-bowed left ridge 42 on the upper concavity 34; the left ridges 42 and 52 are directly opposed from each other. Unlike the left ridge 42, the left ridge 52 is not humped—it is a rounded contour that transitions from the vertical left extremity to the cradle 54. In other words, the concavity 34 has a rounded obtuse corner from the left edge 36 to the left ridge 52, and then rises slightly in the transverse direction from the left ridge 52 to the cradle 54. In the axial direction along the axis X, however, the left ridge 52 descends from a high point proximate the first end 50, because the concavity 35 is shifted or centered close to the frontal plane 16. This shape has three effects on the player's grip. First, because the left ridge 52 does not rise or hump up above the cradle 54 in the transverse direction, the player's index finger, which is seated in the concavity 35 in the transverse direction, can overlie the left ridge 52 comfortably without interruption; the left ridge 52 is not a stop against the index finger and does not press into it. Second, the player can horizontally (along the axis Y) slide, angle, pivot, and orient his index finger for comfortable positioning. Third, the player's index finger is biased inwardly toward the frontal plane 16 as it will tend to slide down the descending slop of the left ridge 52 in the axial direction. This causes the index finger to move toward a straightened position and thereby opens the user's grip up by moving the index finger away from the palm, which creates a more powerful grip between the thumb and index finger in the same way that the left ridge 42 allows the thumb to open on the other side of the toy 10 body 11. This, in turn, creates more powerful play and a more exciting game between the two players.

The right ridge 53 is nearly straight, bowing only slightly outwardly away from the axis X. This corresponds to the right ridge 43 on the upper concavity; the right ridges 43 and 53 are opposed from each other through the body 11, though they are slightly offset along the axis X. The right ridge 53 is a rounded contour that transitions from the vertical right edge 37 to the cradle 54. In other words, the concavity 34 has a rounded obtuse corner from the right edge 37 to the right ridge 53, and then rises slightly in the transverse direction from the right ridge 53 to the cradle 54. In the axial direction along the axis X, however, the right ridge 53 descends to the second end 51 from a high point proximate the first end 50, because the concavity 35 is centered close to the frontal plane 16. Like the left ridge 52, the shape of the right ridge 53 allows the player's index finger to overlie the right ridge 53 comfortably without interruption. The player can also horizontally (along the axis Y) slide, angle, pivot, and orient his index finger for comfortable positioning.

FIGS. 1B and 5 illustrate the second end 51. The second end 51 has a dramatic slope away from the cradle 54: the slope rises from the cradle 54 initially at approximately a ten degree angle and increasing to an approximately fifty degree angle with respect to the axes X and Z at the second end 51 proximate the frontal plane 16. The second end 51 is generally parallel to the frontal plane 16, and the concavity 35 thus terminates parallel to and proximate to the frontal plane 16. The steep face of the second end 51 creates an abutment to the player's grip and prevents the player from moving his index finger forwardly toward or through the frontal plane 16. As such, when the first lobe 30 is gripped with the thumb seated in the upper concavity 34 and the index finger in the lower concavity 35, the index finger is prevented from advancing out of the lower concavity 35.

As seen in FIG. 1B, the second end 51 smoothly transitions from both the left and right ridges 52 and 53. Both the left and right ridges 52 and 53, proximate to the second end 51, turn inwardly and upwardly, thereby melding into the second end 51 to form a roughly triangular face at the second end 51 which transitions into the left edge 36' of the second lobe 31.

Opposite the second end 51, and proximate the first end 12 of the body 11, is the first end 50 of the concavity 35. The first end 50 defines the end of the concavity 35, and is a rounded edge of the toy 10, projecting higher than the cradle 54 (as seen in FIG. 1B and FIG. 5) and then roundly transitioning over to the steep vertical face defining the first end 12. The first end 50 is slightly convex with respect to the frontal plane 16 (the first end 50 bows slightly away from the frontal plane 16) but is otherwise aligned generally parallel to the frontal plane 16. The left and right ridges 52 and 53 extend from opposed ends of the first end 50 at slightly obtuse angles just over ninety degrees, since the left and right ridges 52 and 53 bow outwardly from the opposed ends of the first end 50.

The first end 50 has a pronounced hump, larger than that of the first end 40. The first end 50 projects further away from the cradle 54 in a direction aligned with the axis Z than does the first end 40 with respect to the cradle 44 on the upper concavity 34. Indeed, FIG. 5 clearly shows that the first and second ends 50 and 51 are vertically offset from the cradle 54 more so than are the first and second ends 40 and 41 from the cradle 44. The lower concavity 35 is deeper, or not as shallow, as the upper concavity 34, in the elongate direction along the axis X. This large hump of the first end 50 controls how the toy 11 can be used. Because the concavity 35 is deep, the majority of a player's index finger width can be received therein, and the first end 50 is still exposed behind the index finger. This allows the player to lay a second finger—preferably the middle finger—just behind the index finger but on top of the first end 50 in contact therewith. The addition of a second triphalangeal finger on the toy 10 provides the player with increased grip and mobility. Because the biphalangeal thumb is oriented axially along the axis X, the index and middle fingers are just below the thumb, opposite the toy 10. This allows the gripping force from the thumb to be countered by both the index and middle fingers, resulting in a much stronger grip. Additionally, because first and second ends 50 and 51 define a relatively deep concavity 35 that is sized and shaped to receive the index finger, and actually does seat the index finger, the toy 10 can be rotated on the index finger within a player-desired limit: the player uses his thumb to not only grip the first lobe 30 but also press downward with slightly more force on the first end 40, thereby exerting force behind the index finger backward and causing the toy to pivot along the arcuate line A in FIG. 7A. However, the player can carefully control the speed and degree of this pivoting action by exerting a countering upward force with his middle finger in contact with the first end 50 of the lower concavity 35. This is useful to not only pivot the toy 10 out of the other player's grip but also to resist pivoting of the toy by the other player.

The concavities 34 and 35 have a particular relationship with respect to each other. The concavities 34 and are centered on the body 11 between the left and right extremities 23 and 24, and as such, are aligned with respect to each other along the horizontal axis Y. This allows opposite forces to be applied from both sides of the body 11 by the thumb above and by the index and middle fingers below, which helps ensure the toy 10 will not inadvertently roll to one side or the other. However, the concavities 34 and 35 are offset with respect to each other along the elongate axis X. This offset is characterized by a geometric center B of the cradle 44 which is offset or misaligned with a geometric center C of the cradle 54, namely, the center B of the cradle 44 is closer to the first end 12 than the center C is. Because a thumb, seated in the concavity 34, will fully occupy the concavity 34 and the cradle 44, the effective location of the force applied by the thumb is at the center B. Similarly, because an index finger, seated in the concavity 35, will fully occupy the concavity 35 and the cradle 54, the effective location of the force applied by the index finger is at the center C. Therefore, the locations of the effective forces exerted by the thumb and index finger when the toy 10 is gripped therebetween are offset and misaligned. This allows the player to easily apply torque to the first lobe 30. Applying equal force with the thumb and index finger will cause the toy 10 to tip with the first lobe 30 down and the second lobe 31 up. Applying more force with the thumb than with the index finger will cause the toy 10 to quickly tip with the first lobe 30 down and the second lobe 31 up. This allows the player to quickly change the manner in which he is gripping and pulling the toy 10 away from the other player.

Figure 7A:
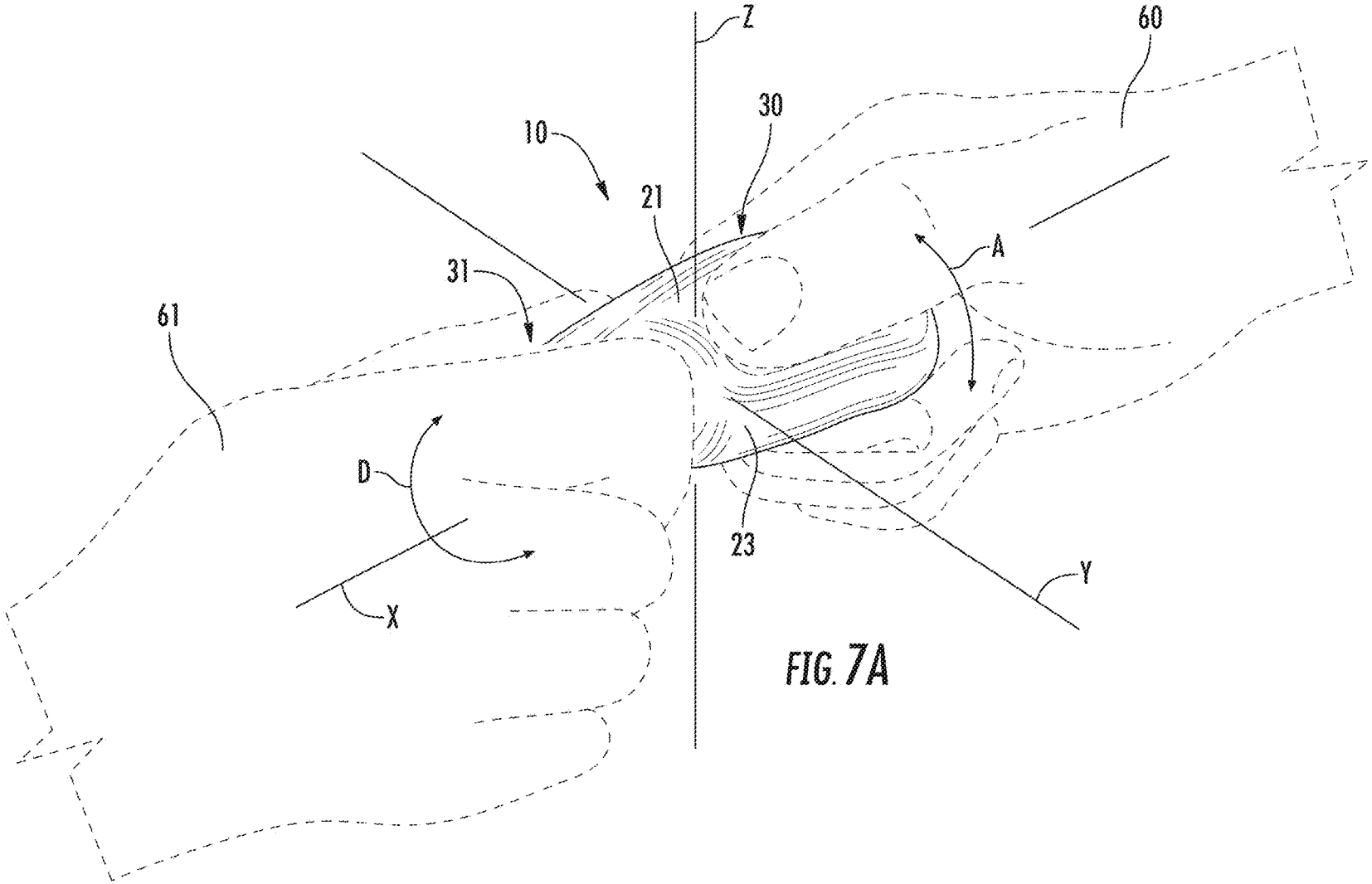
FIGS. 7A and 7B are top and side perspective views of the grasp and tug toy in play, grasped by two players.
Figure 7B:
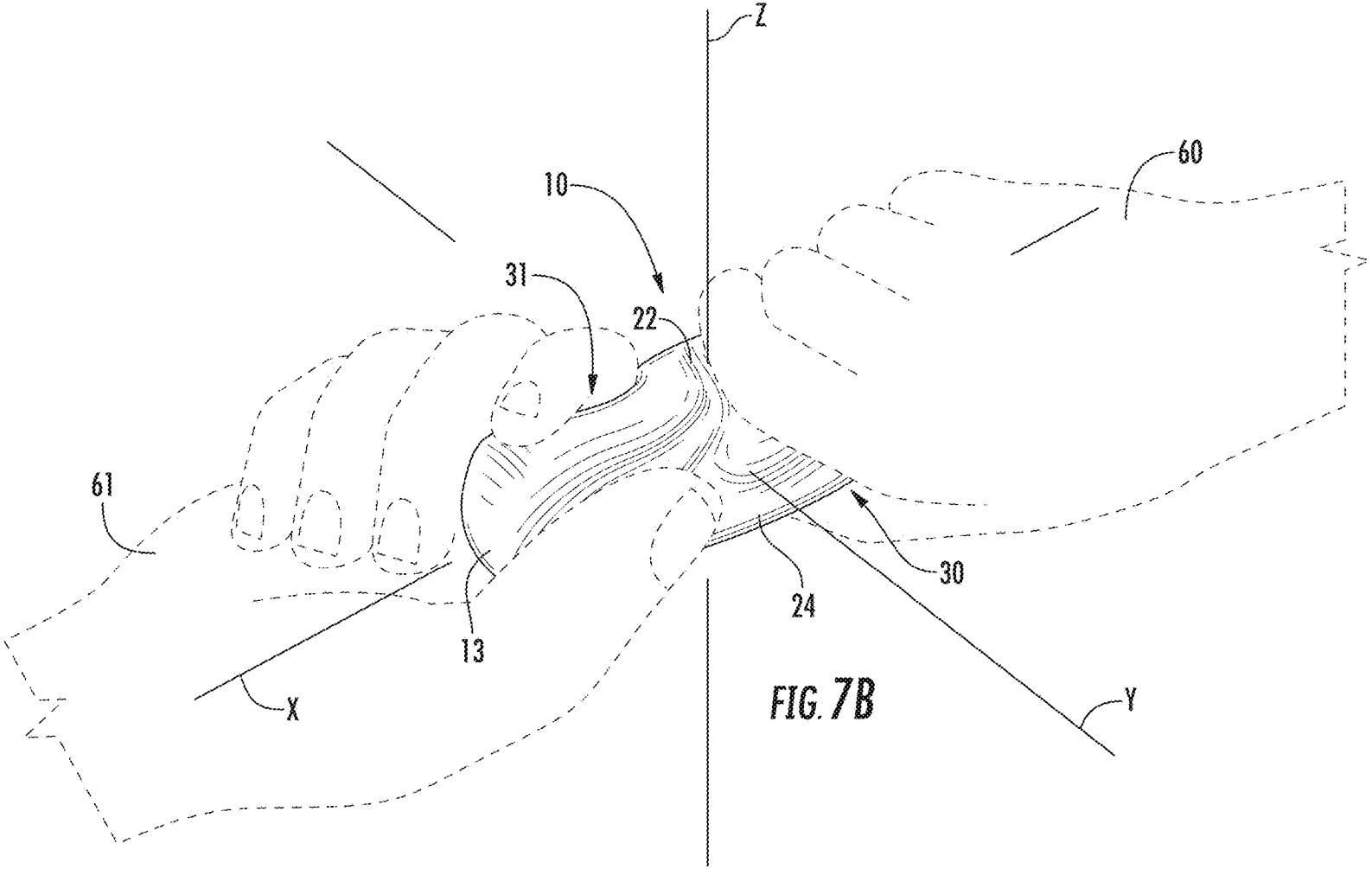

FIGS. 7A and 7B illustrate the toy 10 in play, gripped between two players, whose hands 60 and 61 are shown in broken line. FIG. 7A shows the play from above, with the top 21 of the toy 10 oriented toward the top of the view, while FIG. 7B shows the play from below, with the bottom 22 of the toy 10 oriented toward the top of the view. The hand 60 grips the first lobe 30 and belongs to a player who has been referred to throughout this description as "the player" and as a male, for the sake of clarity only. The hand 61 grips the second lobe 31 and belongs to a player who has been referred to throughout this description as "the other player" and is a female, for the sake of clarity only. As can be seen, each hand 60 and 61 is a right hand. Though the drawings show the toy 10 being grasped by the right hand, one having ordinary skill in the art will appreciate that the toy 10 may be grasped in the left hand by either or both of the players. Further one having ordinary skill in the art will readily appreciate that a mirror identical embodiment to the toy 10 is preferably held between two left hands, but may also be grasped by left and right hands. In FIGS. 7A and 7B, however, the hands 60 and 61 are rotationally offset with respect to each other; though both hands 60 and 61 are aligned along the axis X, they are rotated with respect to each other about the axis X. This is a result of the way in which the lobes 30 and 31 are oriented with respect to each other.

Returning to the views of FIGS. 1A-6, discussion turns to the arrangement of the lobes 30 and 31. As was previously explained, the first and second lobes 30 and 31 are opposed to each other, but are also identical. And while identical, the first and second lobes 30 and 31 are not mirror identical; rather, they are rotationally offset about the axis X, and the structural elements and features of the second lobe 31 are marked with a prime ("") symbol so as to distinguish them from those of the first lobe 30. In FIG. 1A, the toy 10 is shown with the top 21 up. Thus, the upper concavity 34 is directed upwardly and the lower concavity 35, though not visible, is directed downwardly. On the second lobe 31, however, the lower concavity 35' is visible, and is directed toward the left, or toward the front of the page. Indeed, the second lobe 31 is rotated about the axis X by approximately ninety degrees counter-clockwise (as viewed from the perspective of the other player holding the second lobe 31). The second lobe 31 is a rotated, mirror identical of the first lobe 30: the second lobe 31 could be formed by mirroring the first lobe 30 about the frontal plane 16, inverting the left and right sides, and then rotating ninety degrees counterclockwise about the axis X. One having ordinary skill in the art will readily appreciate that other amounts of rotation, both clockwise and counter-clockwise, are suitable for different types of play with other embodiments of the toy 10, which include right-handed, left-handed, and right- and left-handed embodiments.

In other words, returning to the octant-geometry terminology introduced with respect to FIG. 8, the octants on one side of the frontal plane 16 are identical to the octants on the other side of the frontal plane 16, but are rotated ninety degrees. Octant UL1 is identical to octant UR2. The octants thus form four octant pairs: octant UR1 is identical to LR2; octant LR1 is identical to octant LL2; and octant LL1 is identical to UL2. This symmetry characterizes mirrored, inverted, rotated symmetry, as that term is used herein: mirrored because the octants (and the features in each octant) of each octant pair are mirrored about the frontal plane 16; inverted because the octants (and the features in each octant) of each octant pair are inverted in left-right orientation; and rotated because the octants (and the features in each octant) of each octant pair are rotated ninety degrees with respect to each other about the axis X.

This mirrored, inverted, rotated symmetry adds to the excitement of play between the players. The player can pivot the toy 10 by rocking it along the double-arrowed arcuate line A in FIG. 7A. Because the other player's grip is necessarily rotated ninety degree clockwise, she can rock along the double-arrowed arcuate line D. Line A lies in the sagittal plane 15, and line D lies in the transverse plane 14. Thus, the two pivoting actions are in different planes. This means that the players cannot directly counteract the rocking caused by one player with their own rocking in the same direction. Moreover, it means that when the player does rock the first lobe 30 he is grasping, it causes the second lobe 31 the other player is grasping to move laterally between her thumb and index finger. This is transverse to the direction in which she is applying force (she creates force between her thumb and index finger) and as such creates an additional way in which the player can wrest the toy 10 from the other player. Likewise, when the other player rocks the second lobe 31, she creates a rocking action which thereby causes the first lobe 30 the player is grasping to move laterally between his thumb and index finger, or transverse to the direction in which he is applying force.

The players use all of the above-described techniques, and of course, brute grip strength, to attempt to pull the toy 10 from the other's grip. A winner is declared when one of the players loses grip on the toy 10 and it is pulled away.

A preferred embodiment is fully and clearly described above so as to enable one having skill in the art to understand, make, and use the same. Those skilled in the art will recognize that modifications may be made to the description above without departing from the spirit of the invention, and that some embodiments include only those elements and features described, or a subset thereof. To the extent that such modifications do not depart from the spirit of the invention, they are intended to be included within the scope thereof.

The invention claimed is:

1. A toy, comprising: a solid body having two identical lobes arranged on a long axis of the body on opposed sides of the body; and the lobes each have a truncated ovate shape with an outer end and an opposed inner end, wherein the inner ends of the lobes are proximate to each other; wherein: each lobe includes opposed upper and lower concavities; and the upper and lower concavities of each lobe are rotationally offset with respect to each other along the long axis.

2. The toy of claim 1, wherein the lobes are rotationally offset with respect to each other about the long axis.

3. The toy of claim 1, wherein the upper and lower concavities of each lobe are aligned with respect to each other laterally away from the long axis.

4. The toy of claim 1, wherein: the upper concavity of each lobe is elongate along the long axis; and the lower concavity of each lobe is elongate transverse to the long axis.

5. The toy of claim 1, wherein the lower concavity of each lobe is concave along the long axis and is convex transverse to the long axis.

6. The toy of claim 1, wherein: the upper concavities of the lobes are rotationally offset with respect to each other about the long axis; and the lower concavities of the lobes are rotationally offset with respect to each other about the long axis.

7. A toy, comprising:

a solid body having two opposite and identical lobes, the lobes rotated with respect to each other along a long axis of the body; and the lobes each have upper and lower diametrically opposed concavities to receive a thumb and non-thumb finger, respectively, when each lobe is grasped by two opposing players.

8. The toy of claim 7, wherein the upper and lower concavities of each lobe are offset with respect to each other along the long axis.

9. The toy of claim 8, wherein the upper and lower concavities of each lobe are aligned with respect to each other laterally away from the long axis.

10. The toy of claim 7, wherein:

the upper concavity of each lobe is elongate along the long axis; and the lower concavity of each lobe is elongate transverse to the long axis.

11. The toy of claim 7, wherein the lower concavity of each lobe is concave along the long axis and is convex transverse to the long axis.

12. The toy of claim 7, wherein:

the upper concavities of the lobes are rotationally offset with respect to each other about the long axis; and the lower concavities of the lobes are rotationally offset with respect to each other about the long axis.

13. A toy, comprising:

a solid body having two lobes arranged on a long axis of the body on opposed sides of a frontal plane bisecting the body normal to the long axis;

the body includes first, second, third, and fourth octants on a first side of the frontal plane, and first, second, third, and fourth octants on a second side of the frontal plane, wherein the lobes extend through the octants; and wherein each of the first, second, third, and fourth octants on the first side is identical and inverted with respect to the first, second, third, and fourth octants on the second side of the frontal plane, respectively; and wherein none of the first, second, third, and fourth octants on the first side are identical to each other and none of the first, second, third, and fourth octants on the second side are identical to each other.

14. The toy of claim 13, wherein each of the first, second, third, and fourth octants on the first side is rotated with respect to the first, second, third, and fourth octants on the second side of the frontal plane, respectively.

15. The toy of claim 13, wherein each lobe includes opposed upper and lower concavities.

16. The toy of claim 15, wherein the upper and lower concavities of each lobe are offset with respect to each other along the long axis.

17. The toy of claim 15, wherein:

the upper concavity of each lobe is elongate along the long axis; and the lower concavity of each lobe is elongate transverse to the long axis.

18. The toy of claim 15, wherein:

the upper concavities of the lobes are rotationally offset with respect to each other about the long axis; and the lower concavities of the lobes are rotationally offset with respect to each other about the long axis.

19. The toy of claim 15, wherein the upper concavity is shallower than the lower concavity along the long axis.

* * * * *